US008963035B2

(12) United States Patent
Weisburgh

(10) Patent No.: US 8,963,035 B2
(45) Date of Patent: Feb. 24, 2015

(54) ELECTRICAL SWITCHING APPARATUS EMPLOYING ROTARY CONTACT ASSEMBLY

(71) Applicant: Eaton Corporation, Cleveland, OH (US)

(72) Inventor: Rose Ellen Weisburgh, Chevy Chase, MD (US)

(73) Assignee: Eaton Corporation, Cleveland, OH (US)

( * ) Notice: Subject to any disclaimer, the term of this patent is extended or adjusted under 35 U.S.C. 154(b) by 213 days.

(21) Appl. No.: 13/675,161

(22) Filed: Nov. 13, 2012

(65) Prior Publication Data

US 2014/0131185 A1 May 15, 2014

(51) Int. Cl.
*H01H 13/58* (2006.01)

(52) U.S. Cl.
USPC ..... 200/527; 200/528; 200/274

(58) Field of Classification Search
USPC ..... 200/526–528, 502; 335/125
See application file for complete search history.

(56) References Cited

U.S. PATENT DOCUMENTS 4,839,619 A 6/1989 Mutton
4,996,401 A 2/1991 Park
6,097,272 A * 8/2000 Grover et al. ..... 335/207

FOREIGN PATENT DOCUMENTS

DE 10 85 225 B 7/1960
DE 34 41 782 A1 5/1986

OTHER PUBLICATIONS

European Patent Office, "International Search Report and Written Opinion", Dec. 5, 2013, 10 pp.

* cited by examiner

*Primary Examiner* — Edwin A. Leon
*Assistant Examiner* — Ahmed Saeed
(74) *Attorney, Agent, or Firm* — Eckert Seamans Cherin & Mellott, LLC; Nathaniel C. Wilks

(57) ABSTRACT

An electrical switching apparatus comprising: a stationary contact disposed on a conductive path through the electrical switching apparatus; a rotary contact assembly including a roller and a rotary contact disposed on the surface of the roller, the rotary contact being disposed on the conductive path through the electrical switching apparatus; and an operating mechanism configured to initiate a rotation of the roller, wherein the roller is configured to rotate between a first rested state where the stationary contact and the rotary contact are electrically connected and a second rested state where the stationary contact and the rotary contact are electrically disconnected.

17 Claims, 6 Drawing Sheets

ELECTRICAL SWITCHING APPARATUS EMPLOYING ROTARY CONTACT ASSEMBLY

BACKGROUND

1. Field

The disclosed concept relates generally to electrical switching apparatuses and, more particularly, to circuit interrupters.

2. Background Information

One type of electrical switching apparatus is a circuit interrupter. Circuit interrupters, such as for example and without limitation, circuit breakers, are typically used to protect electrical circuitry from damage due to an overcurrent condition, such as an overload condition, a short circuit, or another fault condition, such as an arc fault or a ground fault. Circuit breakers typically include primary separable contacts. The primary separable contacts may be operated either manually by way of a handle disposed on the outside of the case or automatically in response to a detected fault condition. Typically, such circuit breakers include an operating mechanism, which is designed to rapidly open and close the primary separable contacts, and a trip mechanism, such as a trip unit, which senses a number of fault conditions to trip the breaker automatically. Upon sensing a fault condition, the trip unit trips the operating mechanism to a trip state, which moves the separable contacts to their open position.

One type of circuit breaker is a remote circuit breaker. Remote circuit breakers typically include separable contacts which may be operated by a controller. In some remote circuit breakers, the separable contacts are provided as secondary separable contacts operated by the controller along with primary separable contacts operated by a trip unit. Remote circuit breakers can be used, for example, to control lights in stores and office buildings that must turn on or off at certain times of the day. Those times can be programmed into the controller that operates the secondary contacts.

In one remote circuit breaker configuration, coupling and uncoupling of the separable contacts is controlled through the operation of a bi-directional solenoid. The bi-directional solenoid is operated in a first direction to push an operating mechanism to uncouple the separable contacts, and then the bi-directional solenoid is operated in a second opposite direction to pull the operating mechanism to couple the separable contacts.

Bi-directional solenoids require two sets of coils around an actuator in order to support bi-direction operation. Uni-directional solenoids, on the other hand, only require a single set of coils around the actuator. In applications where space is limited (e.g., without limitation, small or miniature circuit breakers), the space for a solenoid is limited, and thus, the total number of coils that can be wrapped around the actuator in the solenoid is limited. Given the same total number of coils around the actuator and the same amount of power, a uni-directional solenoid is able to operate the actuator with more force than a bi-directional solenoid because all the coils in the uni-directional solenoid can be used to apply force to the actuator in a single direction. However, a uni-directional solenoid is not suitable for use with the above-described remote circuit breaker because the operating mechanism requires both pushing and pulling.

There is room for improvement in electrical switching apparatuses.

There is also room for improvement in circuit interrupters.

SUMMARY

These needs and others are met by embodiments of the disclosed concept, which provides an electrical switching apparatus including a rotary contact assembly.

In accordance with embodiments of the disclosed concept, an electrical switching apparatus comprises: a stationary contact disposed on a conductive path through the electrical switching apparatus; a rotary contact assembly including a roller and a rotary contact disposed on the surface of the roller, the rotary contact being disposed on the conductive path through the electrical switching apparatus; and an operating mechanism configured to initiate a rotation of the roller, wherein the roller is configured to rotate between a first rested state where the stationary contact and the rotary contact are electrically connected and a second rested state where the stationary contact and the rotary contact are electrically disconnected.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
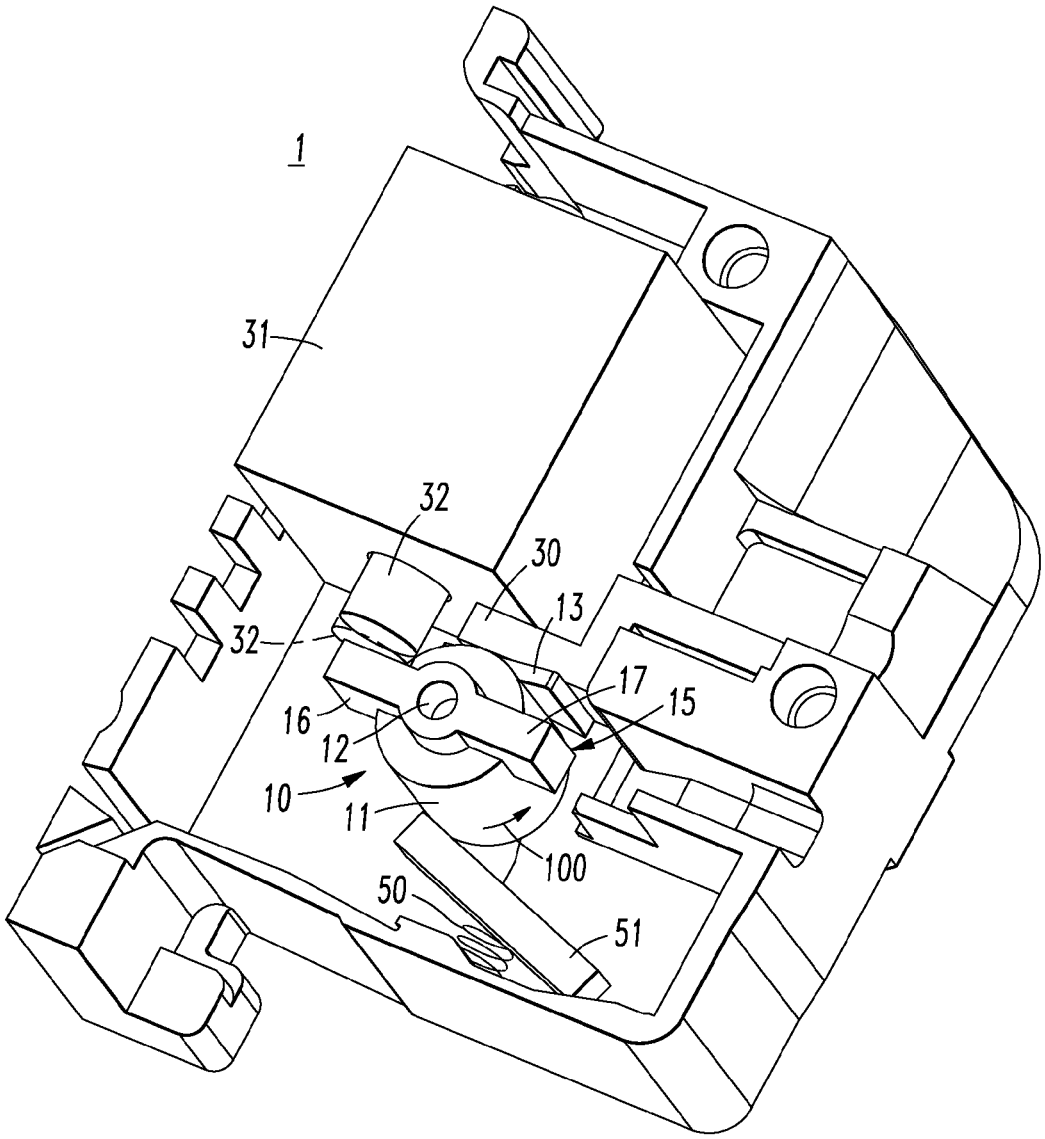
FIGS. 1-3 are isometric views of an electrical switching apparatus in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an electrical switching apparatus 1 such as, for example and without limitation, a circuit interrupter and/or a circuit breaker. The electrical switching apparatus 1 includes a rotary contact assembly 10 disposed therein. The rotary contact assembly 10 includes a roller 11 which is disposed on a conductive axle 12. The roller 11 is configured to rotate (e.g., counterclockwise in the direction of arrow 100, from the perspective of FIG. 1) with respect to the electrical switching apparatus 1. The roller 11 may rotate about the conductive axle 12 (i.e., independently with respect to the axle) or it may rotate in conjunction with the conductive axle 12. The roller 11 may be made of any suitable electrically insulating material.

Figure 7:
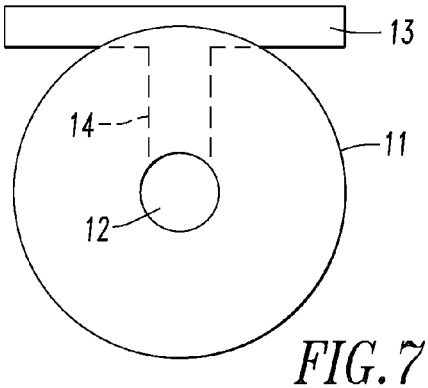
FIG. 7 is an elevation view of a rotary contact in accordance with an example embodiment of the disclosed concept.

The rotary contact assembly 10 also includes a conductive rotary contact 13 which is disposed on the surface of the roller 11. The rotary contact 13 is structured to rotate in conjunction with the roller 11. The rotary contact 13 is electrically connected with the conductive axle 12. The rotary contact 13 can be electrically connected with the conductive axle 12 by any suitable means. For example and without limitation, the rotary contact 13 may include a conductive protruding member 14 that extends through the roller 11 and couples with the conductive axle 12, as shown in FIG. 7. In one example embodiment, the protruding member 14 can also include a brush (not shown) that contacts the conductive axle 12 so as to form an electrical connection between the rotary contact 13 and the conductive axle 12 while allowing the roller and rotary contact 13 to rotate with respect to the conductive axle 12.

Figure 2:
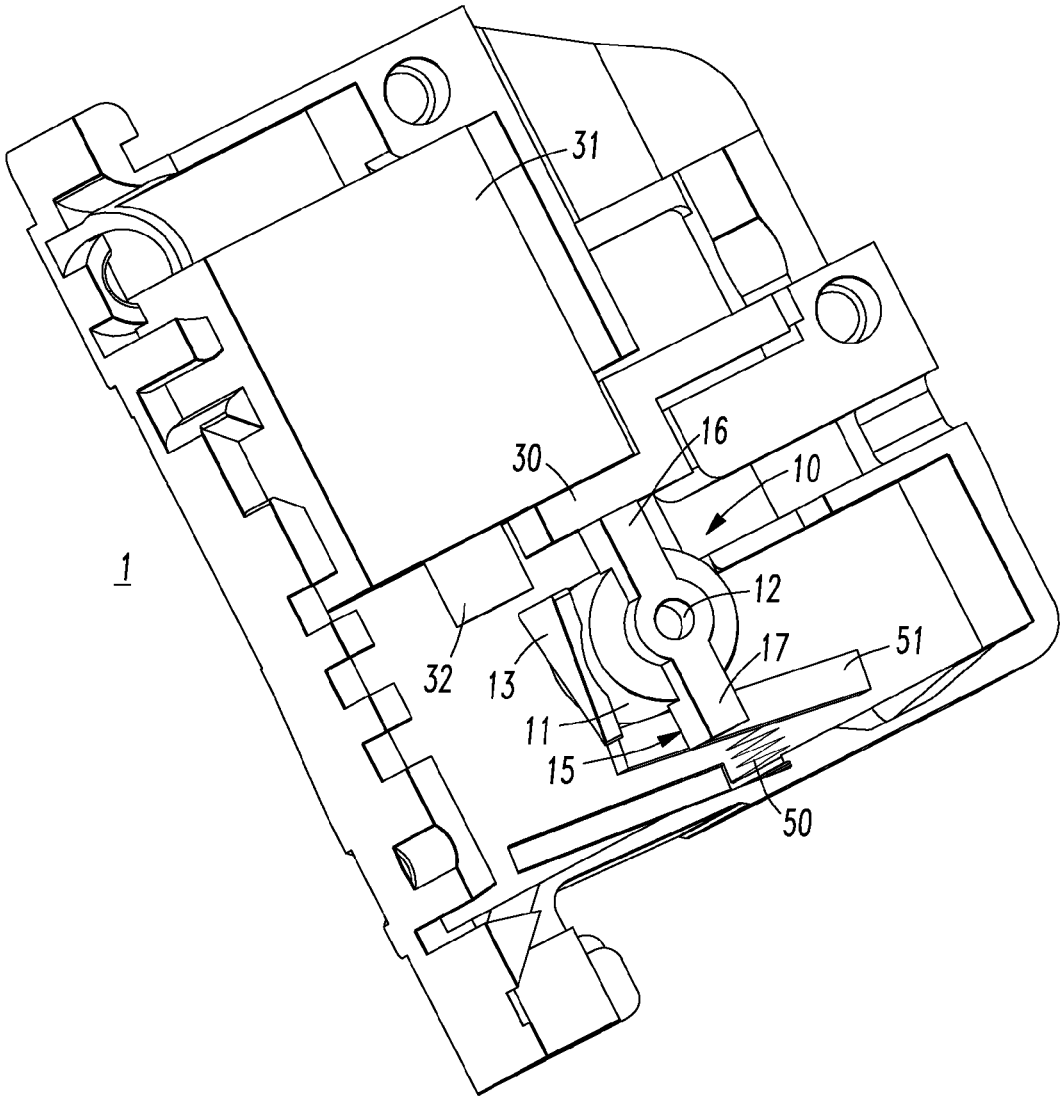
Figure 3:
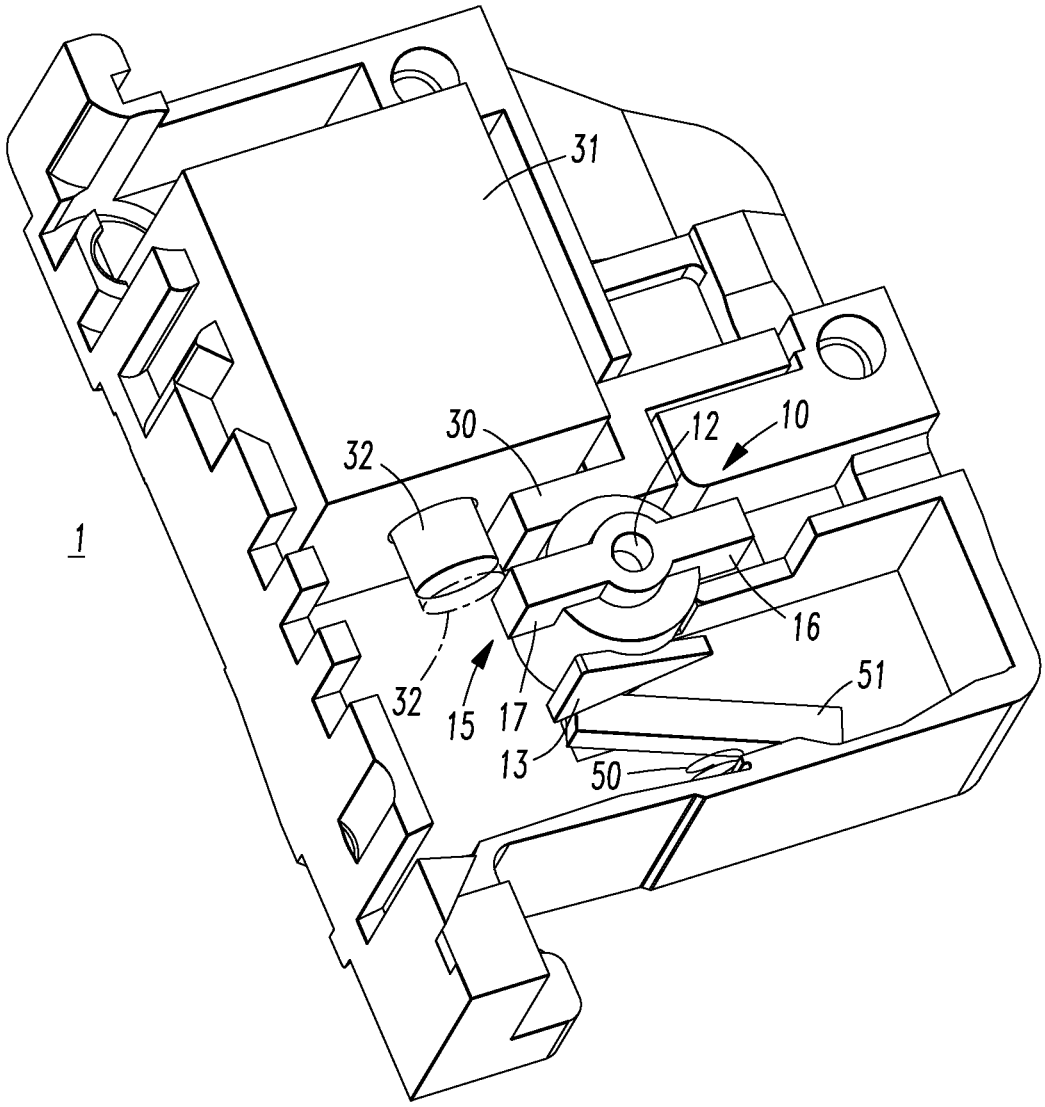

In FIG. 1, the rotary contact assembly 10 is in a first rested state where the rotary contact 13 is in contact with a stationary contact 30 included in the electrical switching apparatus 1. The stationary contact 30, the rotary contact 13, and the conductive axle 12 form a conductive path through the circuit interrupter. In FIG. 2, the rotary contact assembly 10 is in a partially rotated state. In the partially rotated state, the rotary contact 13 is separated from the stationary contact 30 and the conductive path through the circuit interrupter is broken. From the partially rotated state shown in FIG. 2, the rotary contact assembly 10 continues to rotate to a second rested state which is shown in FIG. 3. In the second rested state (FIG. 3), the rotary contact assembly 10 is rotated about 180° with respect to the first rested state (FIG. 1) and the insulating roller 11 is disposed between the stationary contact 20 and the rotary contact 13.

To initiate rotation of the rotary contact assembly 10 from the first rested state to the second rested state, a solenoid 31 included in the electrical switching apparatus 1 is operated. The solenoid 31 includes an actuator 32 that extends and interacts with a paddle member 15 included on the rotary contact assembly 10, thus causing the rotary contact assembly 10 to move laterally away from the stationary contact 30 and to rotate, as shown in FIG. 2. A first operation of the solenoid 31 causes the rotary contact assembly 10 to rotate from the first rested state (FIG. 1), through the partially rotated state, shown in FIG. 2, and into the second rested state of FIG. 3. A second subsequent operation then causes the solenoid 31 to rotate, in the opposite direction, from the second rested state (FIG. 3), through another partially rotated state, and into the first rested state of FIG. 1.

Referring to FIG. 1, the paddle member 15 extends from the conductive axle 12. The paddle member 15 includes a first paddle member 16 which extends in a first direction from the conductive axle 12 and a second paddle member 17 which extends from the conductive axle 12 in a second direction which is opposite of the first direction. When the solenoid 31 is operated to rotate the rotary contact assembly 10 from the first rested state (FIG. 1) to the second rested state (FIG. 3), the actuator 32 presses against the first paddle member 16, as shown in phantom line drawing in FIG. 1. When the solenoid 31 is operated to rotate the rotary contact assembly 10 from the second rested state (FIG. 3) to the first rested state, the actuator 32 presses against the second paddle member 17, as shown in phantom line drawing in FIG. 3.

The paddle member 15 may be configured to rotate about the conductive axle 12 or in conjunction with the conductive axle 12. The paddle member 15 is structured to rotate in conjunction with the roller 11. In the example embodiment shown in FIG. 1, the paddle member 15 is directly coupled with the roller 11. In another example embodiment, the roller 11 and the paddle member 15 are both configured to rotate in conjunction with the conductive axle 12, but are not directly coupled with each other. However, rotation of the paddle member 15 causes rotation of the conductive axle 12, which in turn causes rotation of the roller 11.

Figure 4:
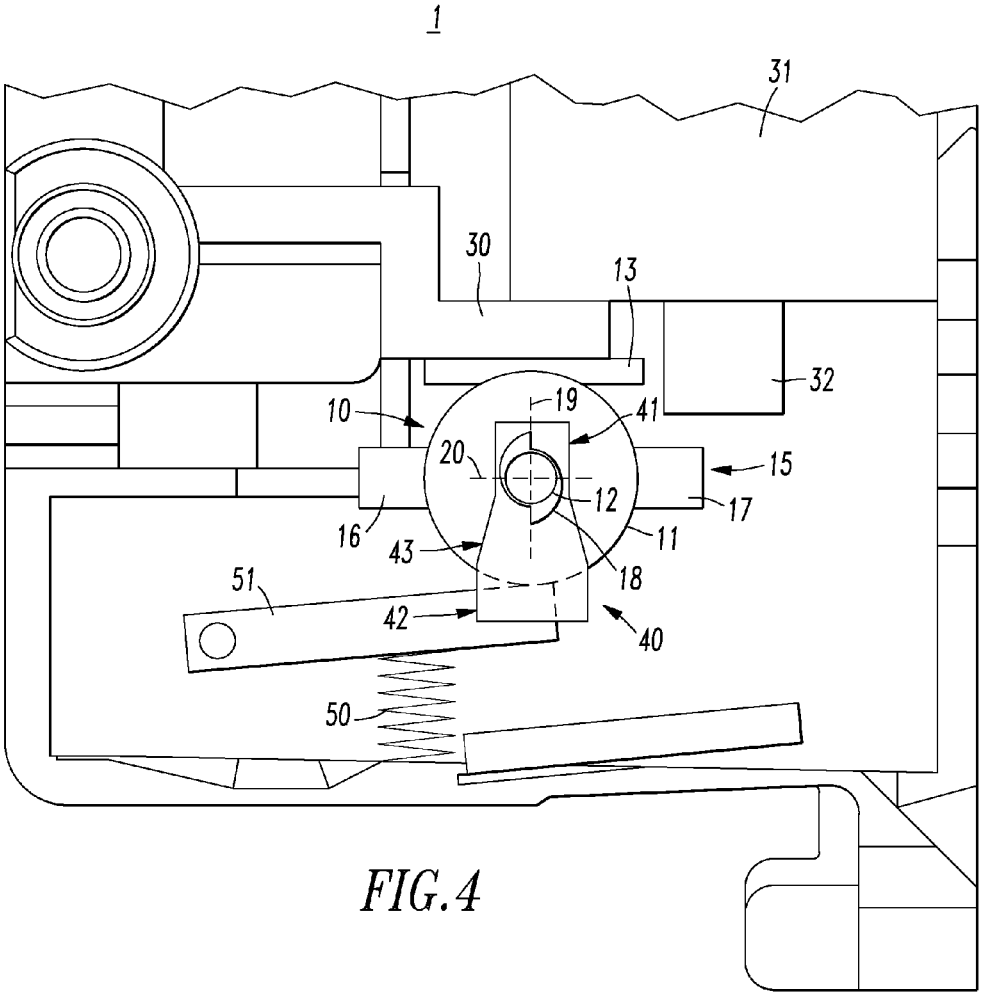
FIGS. 4-6 are elevation views of the electrical switching apparatus shown in FIGS. 1-3.

Referring now to FIG. 4, the electrical switching apparatus 1 also includes a guide slot 40 and the rotary contact assembly 10 includes a guide member 18 disposed on the conductive axle 12. The guide member 18 is structured to fit into the guide slot 40. The guide member 18 has a major axis 19 and a minor axis 20, and the length of the major axis 19 is greater than the length of the minor axis 20.

The guide slot 40 is structured to receive the guide member 18. The guide slot 40 includes a first guide portion 41 which is wider than the minor axis 20 of the guide member 18 but narrower than the major axis 19 of the guide member 18. The guide slot 40 also includes a second guide portion 42 which is wider than the major axis 19 of the guide member 18. The guide slot 40 further includes a tapered portion 43 disposed between the first guide portion 41 and the second guide portion 42. The tapered portion 43 tapers the width of the guide slot 40 between the first guide portion 41 and the second guide portion 42.

Figure 5:
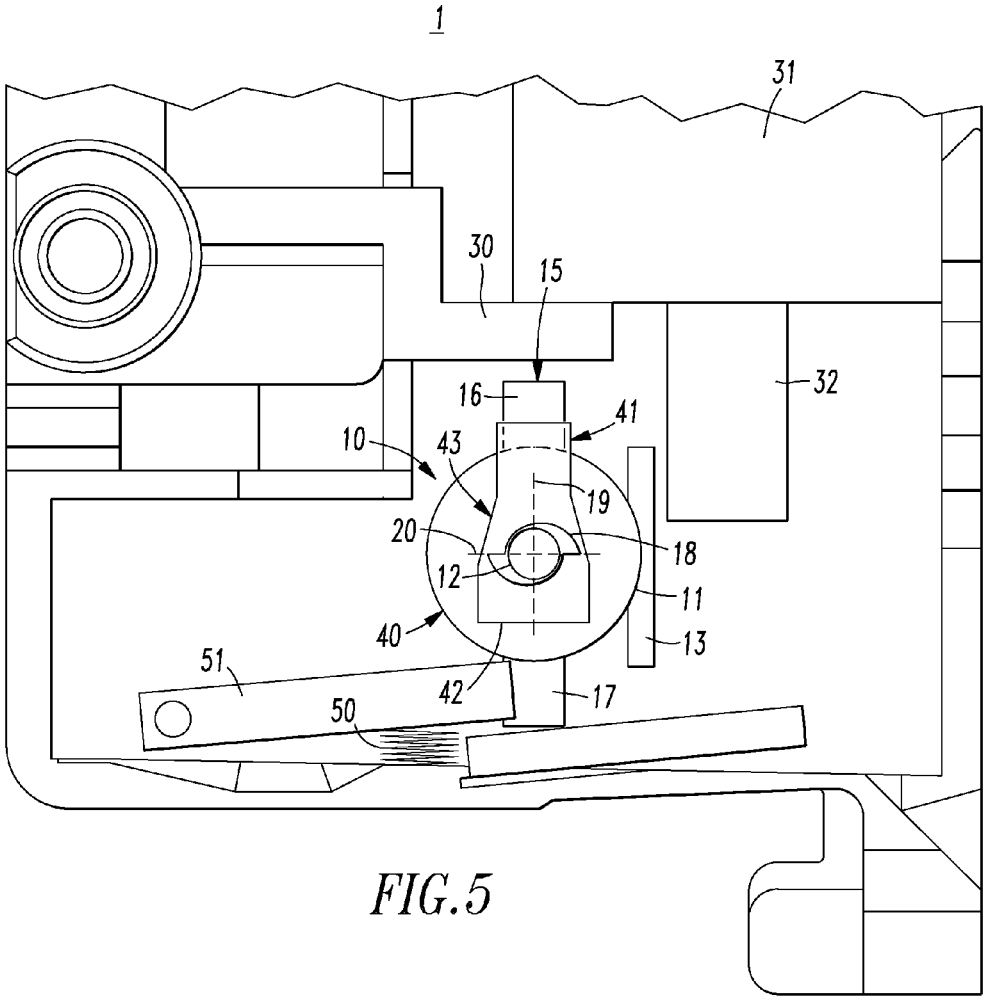
Figure 6:
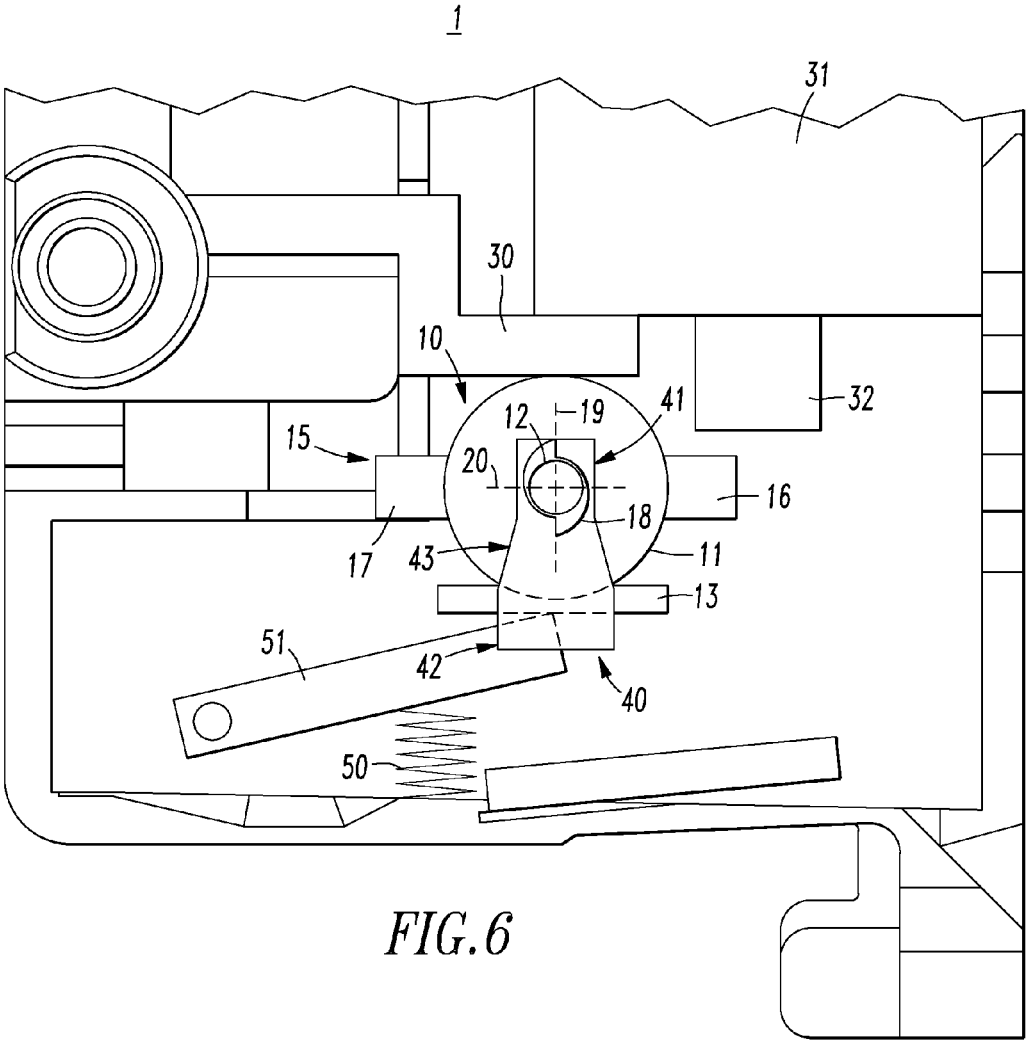

In FIG. 4, the rotary contact assembly 10 is shown in the first rested state. In the first rested state, the guide member 18 is oriented such that the guide member 18 fits into the first guide portion 41 of the guide slot 40. When the guide member 18 is in the first guide portion 41 of the guide slot 40, rotation of the rotary contact assembly 10 is limited due to the width of the first guide portion 41 of the guide slot 40. In FIG. 5, the rotary contact assembly 10 is shown in the partially rotated state. In the partially rotated state, the rotary contact assembly 10 is moved laterally away from the stationary contact 30 and the guide member 18 is moved into the tapered portion 43 or the second guide portion 42 of the guide slot 40. The rotary contact assembly 10 also rotates, and since the guide member 18 is in the tapered portion 43 or second portion 42 of the guide slot 40, the guide member 18 is able to rotate. The rotary contact assembly 10 continues to rotate from the partially rotated state to the second rested state shown in FIG. 6. In the second rested state of FIG. 6, the rotary contact assembly 10 is pressed against the stationary contact 30 and the guide member 18 is disposed in the first guide portion 41 of the guide slot 40, thus limiting rotation of the rotary contact assembly 10.

The electrical switching apparatus 1 further includes an elastic member 50 (e.g., without limitation, a spring) which biases the rotary contact assembly 10 towards the stationary contact 30. In the transition between the partially rotated state and the first or second rested states, the elastic member 50 presses the rotary contact assembly 10 to cause it to move back against the stationary contact 30 and to move the guide member 18 back into the first guide portion 41 of the guide slot 40. In the example embodiment shown in FIGS. 1-6, the elastic member 50 is a spring which provides a bias to the rotary contact assembly 10 through a pivot member 51. However, it is contemplated that any suitable elastic member may be used to provide a bias to the rotary contact assembly 10.

By employing the rotary contact assembly 10, the electrical switching apparatus 1 is able to couple and uncouple the stationary contact 30 and the rotary contact 13 through uni-directional operation of the solenoid 31. As such, a uni-directional solenoid can be employed as the solenoid 31.

In one non-limiting example embodiment of the disclosed concept, the electrical switching apparatus 1 is a remote circuit breaker and the stationary contact 30 and rotary contact 13 are the secondary contacts in the remote circuit breaker. A controller (not shown) can control the operation of the solenoid 31 to electrically connect or disconnect the stationary contact 30 and the rotary contact 13.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:

a stationary contact disposed on a conductive path through the electrical switching apparatus;

a rotary contact assembly including a roller and a rotary contact disposed on the surface of the roller, the rotary contact being disposed on the conductive path through the electrical switching apparatus; and an operating mechanism configured to initiate a rotation of the roller, wherein the roller is configured to rotate between a first rested state where the stationary contact and the rotary contact are electrically connected and a second rested state where the stationary contact and the rotary contact are electrically disconnected, wherein the rotary contact assembly includes a paddle member, the paddle member being coupled with the roller such that the roller rotates in conjunction with the paddle member, and wherein the operating mechanism is a solenoid including an actuator that extends to interact with the paddle member to initiate rotation of the roller.

2. The electrical switching apparatus of claim 1, wherein the rotary contact assembly includes a conductive axle, the conductive axle being disposed on the conductive path through the electrical switching apparatus and electrically connected to the rotary contact.

3. The electrical switching apparatus of claim 2, wherein the roller rotates with respect to the conductive axle.

4. The electrical switching apparatus of claim 2, wherein the roller rotates in conjunction with the conductive axle.

5. The electrical switching apparatus of claim 2, wherein the rotary contact includes a conductive protruding member that extends through the roller and electrically connects the rotary contact to the conductive axle.

6. The electrical switching apparatus of claim 1, wherein the paddle member includes a first paddle member which extends in a first direction from a rotational axis of the rotary contact assembly and a second paddle member which extends in a second direction from said rotational axis, wherein the second direction is opposite of the first direction.

7. The electrical switching apparatus of claim 1, wherein the electrical switching apparatus further includes a guide slot and the rotary contact assembly includes a guide member structured to fit into the guide slot; wherein the guide member is coupled to the roller such that the guide member moves in conjunction with the roller; and wherein an interaction of the guide member and the guide slot limits rotation of the roller.

8. An electrical switching apparatus comprising:

a stationary contact disposed on a conductive path through the electrical switching apparatus;

a rotary contact assembly including a roller and a rotary contact disposed on the surface of the roller, the rotary contact being disposed on the conductive path through the electrical switching apparatus;

an operating mechanism configured to initiate a rotation of the roller;

wherein the roller is configured to rotate between a first rested state where the stationary contact and the rotary contact are electrically connected and a second rested state where the stationary contact and the rotary contact are electrically disconnected, wherein the electrical switching apparatus further includes a guide slot and the rotary contact assembly includes a guide member structured to fit into the guide slot, wherein the guide member is coupled to the roller such that the guide member moves in conjunction with the roller, wherein an interaction of the guide member and the guide slot limits rotation of the roller, wherein the guide member has a major axis and a minor axis, the major axis having a greater length than the minor axis, and wherein the guide slot includes a first guide portion having a width greater than a length of said minor axis and less than a length of said major axis, and a second guide portion having a width greater than a length of said major axis.

9. The electrical switching apparatus of claim 8, wherein said first guide portion is disposed closer to the stationary contact than said second guide portion.

10. The electrical switching apparatus of claim 8, wherein when the operating mechanism initiates rotation of the roller, the operating mechanism pushes the roller laterally away from the stationary contact such that the guide member moves to the second guide portion of the guide slot.

11. The electrical switching apparatus of claim 10, wherein the electrical switching apparatus includes an elastic member structured to bias the roller towards the stationary contact.

12. The electrical switching apparatus of claim 1, wherein the electrical switching apparatus includes an elastic member structured to bias the roller towards the stationary contact.

13. The electrical switching apparatus of claim 1, wherein while the roller rotates between the first rested state and the second rested state, the roller moves laterally away from the stationary contact and laterally back to the stationary contact.

14. The electrical switching apparatus of claim 1, wherein the roller includes an electrically insulating material.

15. The electrical switching apparatus of claim 14, wherein when the roller is in the second rested state, the roller is disposed between the stationary contact and the rotary contact.

16. The electrical switching apparatus of claim 1, wherein the roller is rotated about 180° between the first rested state and the second rested state.

17. The electrical switching apparatus of claim 1, wherein when the roller is in the first rested state and the operating mechanism initiates rotation of the roller, the roller rotates to the second rested state, and when the roller is in the second rested state and the operating mechanism initiates rotation of the roller, the roller rotates to the first rested state.

* * * * *